US011745092B2

(12) United States Patent
Wolfe

(10) Patent No.: US 11,745,092 B2
(45) Date of Patent: Sep. 5, 2023

(54) DOMINO APPARATUS

(71) Applicant: Michael E. Wolfe, Chicago, IL (US)

(72) Inventor: Michael E. Wolfe, Chicago, IL (US)

( * ) Notice: Subject to any disclaimer, the term of this patent is extended or adjusted under 35 U.S.C. 154(b) by 141 days.

(21) Appl. No.: 17/323,857

(22) Filed: May 18, 2021

(65) Prior Publication Data

US 2022/0370892 A1 Nov. 24, 2022

(51) Int. Cl.

| | |
|---|---|
| ***A63F 9/34*** | (2006.01) |
| ***A63F 9/20*** | (2006.01) |
| ***A63F 3/00*** | (2006.01) |

(52) U.S. Cl.

CPC ..... *A63F 9/34* (2013.01); *A63F 3/00697* (2013.01); *A63F 9/20* (2013.01); *A63F 2003/00738* (2013.01); *A63F 2003/00747* (2013.01)

(58) Field of Classification Search

CPC ..... A63F 9/34; A63F 3/00697; A63F 9/20; A63F 2003/00738; A63F 2003/00747; A63H 33/062; A63G 33/086

See application file for complete search history.

(56) References Cited

U.S. PATENT DOCUMENTS

| | | | | |
|---|---|---|---|---|
| 4,212,118 | A | 7/1980 | Baldwin et al. | |
| 4,960,343 | A * | 10/1990 | Reilly | A47B 47/0008 403/171 |
| 5,503,288 | A * | 4/1996 | Conconi | B65D 21/0204 220/4.21 |
| 8,568,186 | B1 | 10/2013 | Sung et al. | |
| D739,895 | S * | 9/2015 | Tellez | D21/391 |
| 9,266,015 | B1 | 2/2016 | Estrada et al. | |
| 9,808,707 | B2 | 11/2017 | Estrada et al. | |
| 10,449,467 | B1 * | 10/2019 | Vaca | A63H 37/00 |
| 2005/0230915 | A1 * | 10/2005 | Alvarez | A63F 3/00697 273/288 |
| 2016/0317910 | A1 * | 11/2016 | Estrada | A63F 3/00694 |
| 2020/0257135 | A1 * | 8/2020 | Ringle | G02C 1/08 |
| 2020/0261785 | A1 * | 8/2020 | Klemm | G06K 19/06037 |

FOREIGN PATENT DOCUMENTS

DE 2845877 A1 6/1980

* cited by examiner

*Primary Examiner* — Michael D Dennis
(74) *Attorney, Agent, or Firm* — Foley & Lardner LLP

(57) ABSTRACT

A game piece assembly includes: a front surface formed in a first predetermined shape and including a predetermined number of pips, a back surface formed in a second predetermined shape, a side surface extending between the front and back surfaces, wherein the front surface, the back surface and the side surface define a hollow space that is configured to hold a prize therein in a closed configuration.

8 Claims, 6 Drawing Sheets

DOMINO APPARATUS

FIELD OF THE INVENTION

The present application relates to a dominoes game set. More particularly, the present application relates to game piece assembly formed of at least two interlocking pieces with a hollow space therein.

DESCRIPTION OF THE RELATED ART

The statements in this section merely provide background information related to the present disclosure.

The game of dominoes is played with gaming pieces known as dominoes. Typically, each domino is a solid rectangular tile with a line dividing its face into two square ends.

Each square end may be marked with a number of dots (also called pips) between one and six, or may be blank. The backs of each domino piece are designed to be indistinguishable from one another. A plurality of domino pieces make up a domino set. Traditionally, the European domino set consists of 28 gaming pieces.

In the game of dominoes, players match the number of dots on different gaming pieces and form lines of play of diverse shapes as the game progresses. One of various rules for playing the game of dominoes is the Five-Up rule.

Under the Five-Up rule, the first player may play any domino in his hand. However, after the first domino has been set, each subsequent player must join a domino from his hand with an open end in the line of play. The ends of the two tiles that are joined must have the same number of pips. If a player is unable to make a play from his hand, he must draw domino pieces from the boneyard until he draws a playable domino piece. If a player is unable to make a play from his hand and there are no tiles left in the boneyard, the player must skip his turn until he is able to make a play.

The player is awarded one point every time he makes a play that results in the open ends of the dominoes in the line of play adding up to a multiple of 5. That is, 1 point will be given for 5 pips, 2 points will be given for 10 pips, and so on. The first player who reaches a predetermined point total wins the game. If the total score exceeds the predetermined point total, then no points are scored for that particular play, and play continues.

When a player runs out of dominoes, he is awarded points based on the total number of pips on the opponents' unplayed dominoes, rounded off to the nearest multiple of 5, then divided by 5. That is, no point will be given for 1 or 2 total number of pips because the number of pips will be rounded off to zero. For the total number of pips between 3-7, the number of pips will be rounded to 5, and dividing it by 5, thus 1 point will be given. Similarly, 2 points will be given for 8-12 total number of pips, and so on. If all players are holding domino pieces in their hands but cannot make a move, each player counts the pips on the remaining domino pieces in his or her hand. The player with the lowest number of pips scores the difference between his total and that of each of his opponents. The player with the next-lowest number of pips scores the difference between his total and that of each of his opponents, and so on. The first player who reaches a predetermined point total wins the game. If the total score exceeds the predetermined point total, then no points are scored for that particular play, and play continues.

The rules of the game of dominoes may be modified to make the game more sophisticated and interesting. While players may wish to play a game of dominoes with various modifications to the rules, the degree of variation may be limited when using conventional domino pieces. For certain variations where more sophistication is sought, domino pieces in a different configuration may be desired.

SUMMARY

In order to expand the scope of the present-day dominoes games and allow a game that is more sophisticated and interesting, the present disclosure provides domino pieces and a dominoes game set including a plurality of the domino pieces.

In one form of the present disclosure, a game piece assembly may comprise: a front surface formed in a first predetermined shape and including a predetermined number of pips; a back surface formed in a second predetermined shape; a side surface extending between the front and back surfaces, wherein the front surface, the back surface and the side surface define a hollow space that is configured to hold a prize therein in a closed configuration. The first and second predetermined shape of the game piece assembly may be the same.

In one form of the present disclosure, the front surface may comprise a first front surface portion and a second front surface portion, wherein at least one of the first and second front surface portions includes a predetermined graphic image; the back surface may comprise a first back surface portion and a second back surface portion; the side surface may comprise a first side surface portion and a second side surface portion; the first front surface portion, the first back surface portion, and the first side surface portion may form a first game piece part; and the second front surface portion, the second back surface portion, and the second side surface portion may form a second game piece part; and the first and second game piece parts may be configured to be connected to each other and form the game piece assembly.

The first game piece part may include a first opening defined by the first front surface, the first back surface, and the first side surface.

The first and second game piece parts may be connected by a pair of polarity magnets, wherein the pair of polarity magnets includes a first magnet disposed on the first game piece part and a second magnet disposed on the second game piece part.

The first magnet may be disposed along a perimeter of the first opening.

The second game piece part may include a second opening defined by the second front surface portion, the second back surface portion, and second first side surface portion, the second magnet may be disposed along a perimeter of the second opening, and the first and second openings may be defined in a same shape and configured to be connected to each other.

The first magnet and the second magnet may have opposite polarities.

The second game piece part may include a protruding portion configured to protrude into the first opening, the first opening may be configured to receive the protruding portion, and when the protruding portion is inserted into the first opening, the first opening and the protruding portion may form an interference fit connection inhibiting separation of the first and second game piece parts.

The protruding portion may be made of a magnetic material and the first game piece part may include a first magnet disposed on an inner surface of the first game piece part.

The game piece assembly may comprise an intermediate connector including a first protruding portion and a second protruding portion, wherein the second game piece part may include a second opening defined by the second front surface portion, the second back surface portion, and the second side surface portion, wherein the first opening may be configured to receive the first protruding portion and the second opening may be configured to receive the second protruding portion, and when the first protruding portion is inserted into the first opening and the second protruding portion is inserted into the second opening, the first game piece part, the intermediate connector, and the second game piece part may form an interference fit connection.

The first and second protruding portions of the intermediate connector may be made of a magnetic material, the first game piece part may include a first magnet disposed on an inner surface of the first game piece part, the second game piece part may include a second magnet disposed an inner surface of the second game piece part, and the first game piece part, the second game piece part, and the intermediate connector may be connected and the connection may be maintained by a magnetic attractive force.

The side surface may include a machine-readable code.

The predetermined shape may be a dog-bone shape.

The first front surface portion may include a first predetermined graphic image, and the second front surface portion may include a second predetermined graphic image.

In another form of the present disclosure, a domino-like game set comprising a plurality of game piece assemblies configured as the game piece assembly described above may be provided.

The plurality of game piece assemblies may include 28 game piece assemblies.

Further areas of applicability will become apparent from the description provided herein. It should be understood that the description and specific examples are intended for purposes of illustration only and are not intended to limit the scope of the present disclosure.

DETAILED DESCRIPTION OF THE PREFERRED EMBODIMENTS

Figure 1:
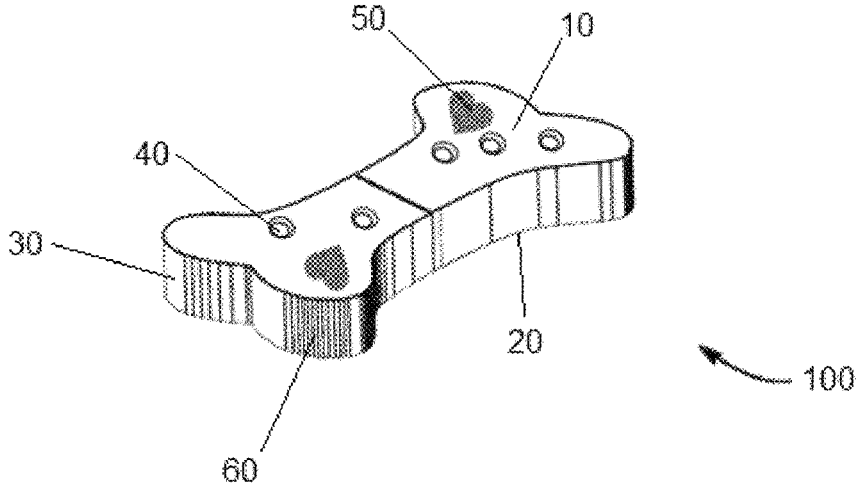
FIG. 1 shows a perspective view of a game piece assembly in a closed configuration according to one form of the present disclosure.

The following description is merely exemplary in nature and is not intended to limit the present disclosure, application, or uses. It should be understood that throughout the drawings, corresponding reference numerals indicate like or corresponding parts and features.

As described in the Background section, a domino game piece assembly is typically a solid rectangular tile with a line dividing its face into two square ends. Each square end may be marked with a number of dots (also called pips) between one and six, or may be blank. The rules of the game of dominoes may be modified to make the game more sophisticated and interesting. However, the degree of modification may be limited due to the simplicity of the conventional solid rectangular tile.

The present disclosure provides domino pieces and a domino game set including the domino pieces having a hollow space that holds a prize therein to be played under various modifications to the Five-Up rule. The rule may generally be identical to the Five-Up rule except the modifications provided in the following paragraph.

Under one modification to the Five-Up rule, the game may begin with the double fives as the starting domino piece. Each player may select five domino pieces from the boneyard to begin the game. When the player has no domino piece to play, the player picks a domino piece from the boneyard and skips a turn. Once a domino piece is placed down and the player earns points, the player may open the domino piece and obtain a prize included therein. The domino piece will be placed back down to continue the play. Additionally, the first player to score points may earn an additional 10 points from the starting piece. In another variation, the winning player who first reaches a predetermined score may obtain a prize, which may be in addition to the prizes included in the domino pieces. For a play under this modification, a domino piece may have a hollow space to hold a prize therein.

FIG. 1 shows a perspective view of a domino piece assembly in a closed configuration according to one form of the present disclosure. In one form of the present disclosure, the domino piece assembly 100 may comprise a front surface 10 formed in a first predetermined shape and include a predetermined number of pips 40, a back surface 20 formed in a second predetermined shape and a side surface 30 extending between the front and back surfaces 10, 20. The front surface 10, the back surface 20, and the side surface 30 together may define a hollow space therein in a closed configuration such that a small prize such as a snack, jewelry, and/or coupons may be enclosed therein. The front surface 10 may further include a predetermined graphic image 50.

The pips 40 and/or the graphic image 50 on the front surface 10 may be recessed, in plane with the front surface, or embossed such that the graphic image protrudes from the front surface 10. It is desirable that the pips 40 and the graphic image 50 are in plane with the front surface 10 such that a player may not identify the number of pips 40 and the graphic image 50 by touching the domino piece assembly 100 prior to selecting the pieces for a play. When the pips 40 and the graphic image 50 are in plane with the front surface 10, the pips 40 and the graphic image 40 may be directly printed on the front surface 10 of the domino piece assembly 100, or may be printed on a film and attached to the front surface 10 by an adhesive (e.g., a sticker).

The graphic image 50 may be any figure that may be considered suitable by a person skilled in the art. Examples of the graphic image 50 may include fruits, flowers, animals, etc. The side surface 30 may additionally include a machine-readable code 60, such as a barcode or a QR code, containing data of the domino piece including the number of pips 40 and the graphic image 50. The machine-readable code 60 may include data to be scanned by a scanning device (not shown) and to be played through a website or a mobile application for virtual play.

The back surface 20 may not include the pips 40 or the graphic image 50 such that the players cannot identify and selectively choose playing pieces when the domino piece assembly 100 is face down in the boneyard for a play.

The domino piece assembly may be configured to be openable by various means known in the art such that a prize can be placed within the hollow space defined by the front surface 10, the back surface 20, and the side surface 30. Examples may include a flip-open connection with a hinge, a sliding connection, and/or a twist connection.

In one form of the present disclosure, it is preferable that the domino piece assembly comprises a first part and a second part that are configured to be separable and connectable to each other. This embodiment is advantageous because a domino piece assembly comprising a plurality of parts, while allowing the domino piece assembly to open and close, allows further modifications to the rules. For example, one of the modified rules may involve a player starting with 5 first parts and 5 second parts with the pips side down such that a player does not know the number of pips on each part. In order to place a domino piece down, the player would be required to form a complete domino piece by assembling the first part and the second part such that either the first or the second parts has the number of pips that is identical to an open end in the line of play. The first and second parts to be assembled may be selected from parts a player has at his or her hands at the player's discretion.

Figure 2A:
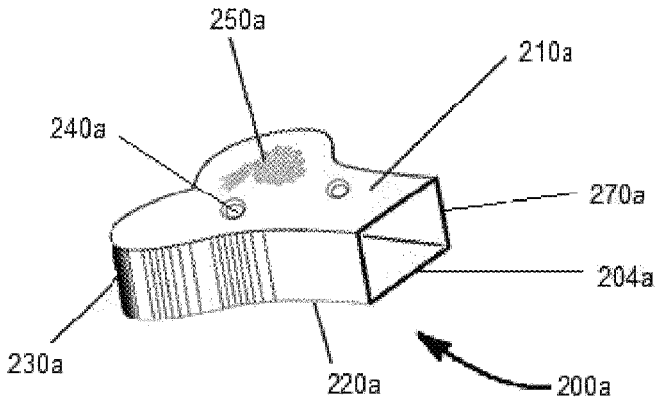
FIG. 2A shows a perspective view of a first game piece part of the game piece assembly according to one form of the present disclosure.

FIG. 2A shows a perspective view of the first part of the domino piece assembly according to one form of the present disclosure. The first part 200*a* may include a first front surface 210*a*, a first back surface 220*a*, and a first side surface 230*a*. The first front surface 210*a*, the first back surface 220*a*, and the first side surface 230*a* may together define a hollow space and a first opening 270*a* to the hollow space. The first front surface 210*a* may include a predetermined number of pips 240*a*. The first front surface 210*a* may further include a predetermined graphic image 250*a*.

Figure 2B:
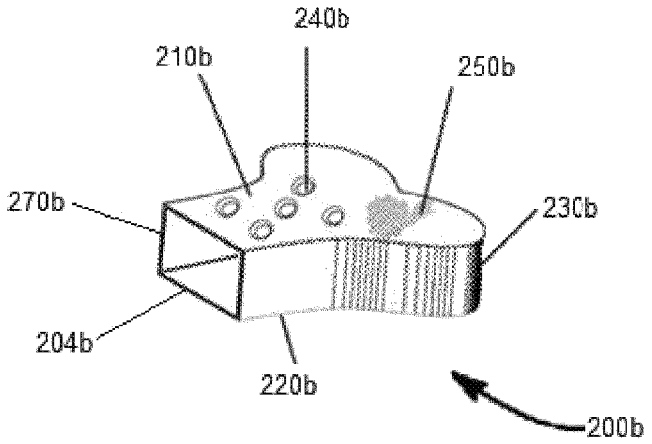
FIG. 2B shows a perspective view of a second game piece part of the game piece assembly according to one form of the present disclosure.

The second part of the domino piece may be symmetrical in general shape to the first part. FIG. 2B shows a perspective view of the second part of the game piece assembly according to one form of the present disclosure. That is, the second part 200*b* may include a second front surface 210*b*, a second back surface 220*b*, and a second side surface 230*b*, and the second front surface 210*b*, the second back surface 220*b*, and the second side surface 230*b* may together define a hollow space and a second opening 270*b* to the hollow space. The second front surface 210*b* may include a predetermined number of pips 240*b* and a predetermined graphic image 250*b*.

The number of pips 240*b* on the second part 200*b* may be the same as or different than the number of pips 240*a* on the first part 200*a*. Also, the graphic image 250*b* on the second part 200*b* may be the same as or different than the graphic image 250*a* on the first part 200*a*. There may be at least two different graphic images to further modify game play. For example, the player may still be required to start with 5 first parts and 5 second parts. In order to lay a domino piece down, the player would be required to assemble the first part and the second part, thereby forming a complete domino piece such that either the first part or the second part has the number of pips that is identical to an open end in the line of play. When the first and second parts having different graphic images are connected and laid down, the player may only be awarded predetermined base points.

On the other hand, when the first and second parts having the same graphic images are connected and laid down, a player may be awarded additional points (e.g., double the base points).

The first part 200*a* and the second part 200*b* are configured to be connectable to each other. In one embodiment, the first part 200*a* and the second part 200*b* may be connected by a pair of opposite polarity magnets including a first magnet 204*a* and a second magnet 204*b*. The first magnet 204*a* may be disposed or integrated along a perimeter of the first opening 270*a*, and the second magnet 204*b* may be disposed or integrated along a perimeter of the second opening 270*b*. The first and second magnets 204*a* and 204*b* would have opposite polarities such that the first and second magnets 204*a* and 204*b* provide an attractive magnetic force that holds the first and second parts 200*a*, 200*b* together. However, the attractive magnetic force is weak enough that a person is able to manually separate the first and second parts 200*a*, 200*b* from each other, such as with his/her hands. When connected and the domino piece is in a closed configuration, that is, when the first and second parts 200*a*, 200*b* are connected and a closed hollow space is formed in the domino piece, the front surfaces 210*a*, 210*b*, the back surfaces 220*a*, 220*b*, and the side surfaces 230*a*, 230*b* form a continuous surface, thereby forming a complete domino piece.

Figure 3A:
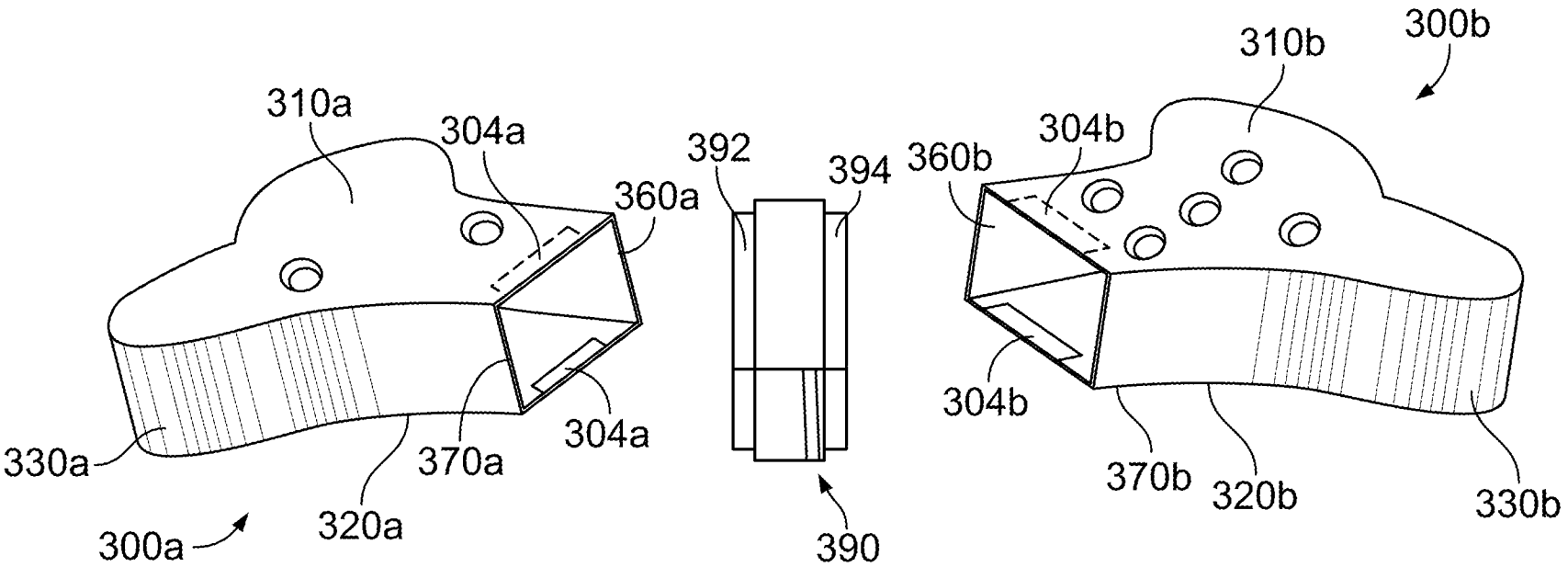
FIG. 3A shows a perspective view of the game piece assembly in a separated configuration according to another form of the present disclosure.
Figure 3B:
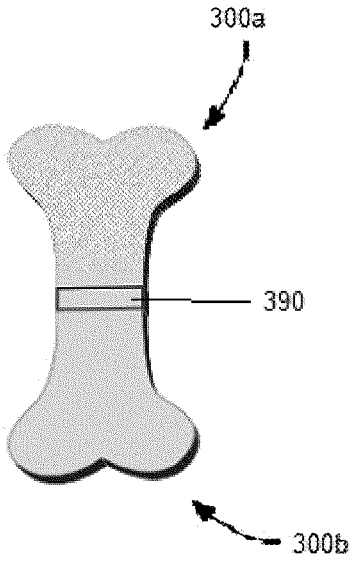
FIG. 3B shows a plan view of the game piece assembly in a closed configuration according to another form of the present disclosure.
Figure 3C:
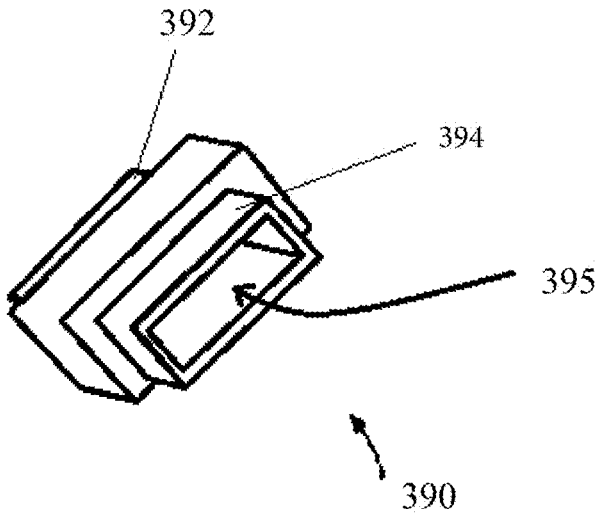
FIG. 3C shows a perspective view of an intermediate connector connecting the first and second game piece parts according to one form of the present disclosure.

In another embodiment shown in FIGS. 3A-3C, the first and second parts 300*a*, 300*b* may be connected by a male-male connector 390. The first and second parts 300*a*, 300*b* may be formed as described above, such that each part includes front surfaces 310*a*, 310*b*, back surfaces 320*a*, 320*b*, and side surfaces 330*a*, 330*b* defining a hollow space. Both the first and second parts 300*a*, 300*b* may have an opening 370*a*, 370*b* to function as female connectors configured to receive a protruding male portion of the double male-sided connector 390. The connector 390 may include a first protruding portion 392 and a second protruding portion 394. In one form, the first and second protruding portions 392, 394 may be made of a magnetic material and the first and second parts 300*a*, 300*b* may include magnets each disposed on the first part 300*a* and the second part 300*b*. The first magnet 304*a* disposed on the first part 300*a* may be disposed on inner surface 360*a* of the first part 300*a*. Likewise the second magnet 304*b* disposed on the second part 300*b* may be disposed on inner surface 360*b* of the second part 300*b*.

Alternatively, the protruding portions 392, 394 may be configured to snugly fit into the first and second openings 370*a*, 370*b*, thereby forming an interference fit or a friction fit between the parts. FIG. 3A shows a perspective view of each of the domino components in an open configuration, and FIG. 3B shows a plan view of the domino components in a closed configuration. When connected and the domino piece is in a closed configuration, the front surfaces 310*a*, 310*b*, the back surfaces 320*a*, 320*b*, and the side surfaces 330*a*, 330*b* together form a continuous surface, thereby forming a complete domino piece. In this embodiment, the connecter 390 may be a solid component, and the first and second parts 300*a*, 300*b* may each include a hollow space, thereby allowing two prizes to be placed in a domino piece.

Alternatively, as shown in FIG. 3C, the connector 390 may include a lumen 395 such that the first part 300*a*, second part 300*b*, and connector 390 together define a hollow space, allowing a prize of a larger size to be placed inside the domino piece.

Figure 4A:
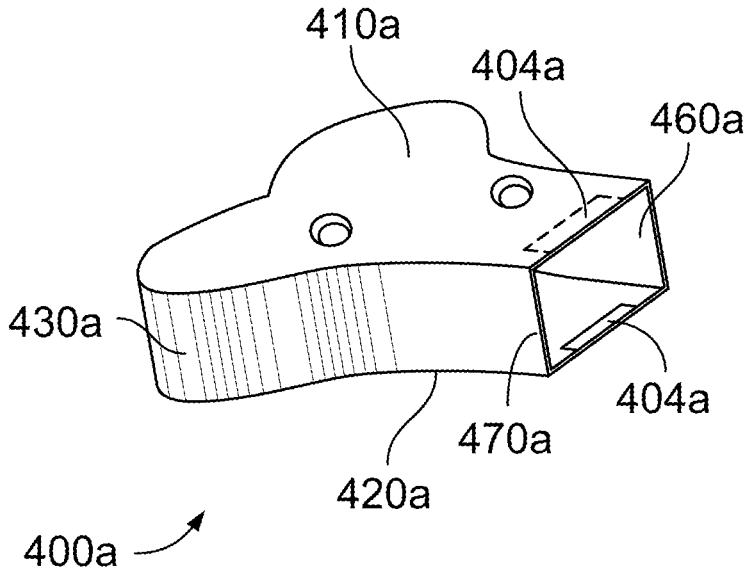
FIG. 4A shows a perspective view of a first game piece part of the game piece assembly according to another form of the present disclosure.
Figure 4B:
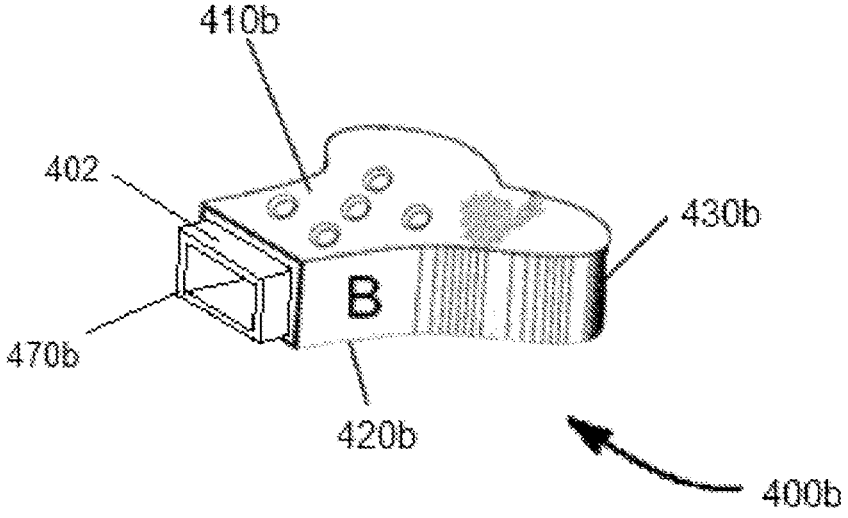
FIG. 4B shows a perspective view of a second game piece part of the game piece according to another form of the present disclosure.

In another embodiment, there may not be a separate male-male connector component. Instead, the first and second parts may directly be connected to each other by a male-female connection. FIG. 4A shows a perspective view of a first part 400*a* according to another embodiment. In this embodiment, the first part 400*a* may be identical to the embodiments disclosed above, such that it includes a front surface 410*a*, back surface 420*a*, and a side surface 430*a* that together define an opening 470*a*. The second part 400*b*, shown in FIG. 4B, may include a front surface 410*b*, a back surface 420*b*, and a side surface 430*b*. The second part may further include a protruding portion 402 that is configured to snugly fit into the first opening 470*a*, thereby forming an interference fit or a friction fit to connect the first and second parts 400*a*, 400*b*. When connected and the domino piece is in a closed configuration, the front surfaces 410*a*, 410*b*, the back surfaces 420*a*, 420*b*, and the side surfaces 430*a*, 430*b* together form a continuous surface, thereby forming a complete domino piece. In one embodiment, the protruding portion 402 may have a closed end such that only the first part 400*a* may be hollow. Alternatively, as shown in FIG. 4B, the protruding portion 402 may include a second opening 470*b* such that both the first and second parts 400*a*, 400*b* has a hollow space therein, thereby allowing a prize of larger size to fit inside the domino piece. As with the embodiment described above, the protruding portion 402 may be made of a magnetic material and the first part 400*a* may include a first magnet 404*a* disposed on an inner surface 460*a* thereof.

While the domino piece according to the various embodiments disclosed herein may be formed in any desired shape including conventional rectangular tile, it is preferable that the domino pieces are formed in various other shapes including a coffin shape, dog-bone shape, hourglass shape, Y-shape, etc. based on the concept of the game. It is preferable that the predetermined shape has a narrower center portion such as the dog-bone shape.

Furthermore, it is preferable that the domino piece according to the various embodiments disclosed herein is made of a lightweight material such as plastic, aluminum, or resin such that when a prize is placed inside the domino piece, the domino piece is not heavy for users to play with.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A game set comprising a plurality of game piece assemblies, wherein each game piece assembly comprises: a front surface formed in a first predetermined shape and including a predetermined number of pips; a back surface formed in a second predetermined shape; a side surface extending between the front and back surfaces, wherein the front surface, the back surface and the side surface define a hollow space that is configured to hold a prize therein in a closed configuration, wherein the first and second predetermined shapes are the same; wherein: the front surface comprises a first front surface portion and a second front surface portion, at least one of the first and second front surface portions includes a predetermined graphic image, the back surface comprises a first back surface portion and a second back surface portion, the side surface comprises a first side surface portion and a second side surface portion, the first front surface portion, the first back surface portion, and the first side surface portion form a first game piece part, the side surface comprises a first side surface portion and a second side surface portion, the first front surface portion, the first back surface portion, and the first side surface portion form a first game piece part, the second front surface portion, the second back surface portion, and the second side surface portion form a second game piece part, and the first and second game piece parts are configured to be connected to each other and form the game piece assembly, the first game piece part includes a first opening defined by the first front surface, the first back surface, and the first side surface, the second game piece part includes a protruding portion configured to protrude into the first opening, the first opening is configured to receive the protruding portion, and when the protruding portion is inserted into the first opening, the first opening and the protruding portion form an interference fit connection inhibiting separation of the first and second game piece parts, and the protruding portion comprises a magnetic material and the first game piece part includes a first magnet disposed on an inner surface of the first game piece part; wherein the plurality of game piece assemblies includes 28 game piece assemblies.

2. The game piece assembly of claim 1, wherein the side surface includes a machine-readable code.

3. The game piece assembly of claim 1, wherein the predetermined shape is a dog-bone shape, coffin shape, hourglass shape, or Y-shape.

4. The game piece assembly of claim 1, wherein the first front surface portion includes a first predetermined graphic image, and the second front surface portion includes a second predetermined graphic image.

5. A game set comprising: a plurality of game piece assemblies, wherein each game piece assembly comprises: a front surface formed in a first predetermined shape and including a predetermined number of pips, a back surface formed in a second predetermined shape; a side surface extending between the front and back surfaces, wherein the front surface, the back surface and the side surface define a hollow space that is configured to hold a prize therein in a closed configuration, wherein the first and second predetermined shapes are the same; wherein: the front surface comprises a first front surface portion and a second front surface portion, at least one of the first and second front surface portions includes a predetermined graphic image, the back surface comprises a first back surface portion and a second back surface portion, the side surface comprises a first side surface portion and a second side surface portion, the first front surface portion, the first back surface portion, and the first side surface portion form a first game piece part, the second front surface portion, the second back surface portion, and the second side surface portion form a second game piece part, and the first and second game piece parts are configured to be connected to each other and form the game piece assembly, the first game piece part includes a first opening defined by the first front surface, the first back surface, and the first side surface, the first game piece part further comprising an intermediate connector including a first protruding portion and a second protruding portion, the second game piece part includes a second opening defined by the second front surface portion, the second back surface portion, and second side surface portion, the first opening is configured to receive the first protruding portion and the second opening is configured to receive the second protruding portion, and when the first protruding portion is inserted into the first opening and the second protruding portion is inserted into the second opening, the first game piece part, the intermediate connector, and the second game piece part form an interference fit connection, the first and second protruding portions of the intermediate connector comprise a magnetic material, the first game piece part includes a first magnet disposed on an inner surface of the first game piece part, the second game piece part includes a second magnet disposed an inner surface of the second game piece part, and the first game piece part, the second game piece part, and the intermediate connector are releasably connected and the connection is maintained by a magnetic attractive force; wherein the plurality of game piece assemblies includes 28 game piece assemblies.

6. The game piece assembly of claim 5, wherein the side surface includes a machine-readable code.

7. The game piece assembly of claim 5, wherein the predetermined shape is a dog-bone shape, coffin shape, hourglass shape, or Y-shape.

8. The game piece assembly of claim 5, wherein the first front surface portion includes a first predetermined graphic image, and the second front surface portion includes a second predetermined graphic image.

* * * * *